US010401005B1

(12) United States Patent
Gathers et al.

(10) Patent No.: US 10,401,005 B1
(45) Date of Patent: Sep. 3, 2019

(54) SELF-RIGHTENING RISER BASE

(71) Applicant: Premises Innovations LLC, Indianapolis, IN (US)

(72) Inventors: Garth N. Gathers, Indianapolis, IN (US); Timothy J. O'Brien, Indianapolis, IN (US)

(73) Assignee: PREMISES INNOVATIONS LLC, Indianapolis, IN (US)

( * ) Notice: Subject to any disclaimer, the term of this patent is extended or adjusted under 35 U.S.C. 154(b) by 0 days.

(21) Appl. No.: 16/248,740

(22) Filed: Jan. 15, 2019

(51) Int. Cl.

| | |
|---|---|
| ***F21V 15/04*** | (2006.01) |
| ***F21V 21/10*** | (2006.01) |
| ***F21S 8/08*** | (2006.01) |
| ***F21V 21/14*** | (2006.01) |

(52) U.S. Cl.
CPC ..... *F21V 21/10* (2013.01); *F21S 8/081* (2013.01); *F21V 15/04* (2013.01); *F21V 21/14* (2013.01); *Y10T 403/459* (2015.01); *Y10T 403/54* (2015.01)

(58) Field of Classification Search
CPC ..... F21V 21/14; F21V 21/32; F21V 15/04; F21S 8/081; F21S 8/083; Y10T 403/11; Y10T 403/459; Y10T 403/54; E01F 9/627; E01F 9/629
See application file for complete search history.

(56) References Cited

U.S. PATENT DOCUMENTS 1,145,382 A * 7/1915 McWilliams ..... F21V 15/04 362/390
1,771,817 A 8/1929 Ragsdale
1,802,589 A * 4/1931 Thompson ..... F21V 15/04 248/613
1,866,982 A 7/1932 Michener
1,903,683 A 4/1933 Nute
2,204,316 A * 6/1940 Miller ..... F21V 15/04 174/139
2,481,494 A * 9/1949 Bonthron ..... F21V 15/04 248/610
2,492,837 A * 12/1949 Briggs ..... F21S 9/022 200/184

(Continued)

FOREIGN PATENT DOCUMENTS

GB 402596 A * 12/1933 ..... F21V 15/04
GB 854155 A * 11/1960 ..... F21V 15/04
GB 1156350 A * 6/1969 ..... F21V 15/04

*Primary Examiner* — Matthieu F Setliff
(74) *Attorney, Agent, or Firm* — Invention To Patent Services; Alex Hobson

(57) ABSTRACT

A self-rightening riser base self-rightens a riser coupled thereto when knocked from a desired orientation by an object. A riser coupler aperture in the riser base is oversized to allow the riser to move and deflect. A floating flange is configured an offset distance under the cap and is attached to the cap by spring bolts that extend down through the cap to the floating flange. The riser is coupled to the floating flange by a riser coupler. The spring bolt apertures in the cap are oversized to allow the spring bolts to move therein and therefore allow the floating flange and riser coupled thereto to deflect. An electrical fixture may extend through the riser coupler and through a conduit in the riser to an electrical fixture, such as a light. A grommet may be configured in the riser coupler aperture of the cap and prevent water from passing therethrough.

20 Claims, 6 Drawing Sheets

(56) References Cited

U.S. PATENT DOCUMENTS

| | | | | | |
|---|---|---|---|---|---|
| 2,753,391 | A | * | 7/1956 | Northup | F21V 15/04 174/62 |
| 3,639,752 | A | * | 2/1972 | Appleton | F21V 21/02 174/61 |
| 4,161,723 | A | | 7/1979 | De Vittori | |
| 4,737,048 | A | | 4/1988 | Herrstrom | |
| 5,044,587 | A | | 9/1991 | Degen | |
| 5,626,418 | A | | 5/1997 | Angelis, Sr. et al. | |
| 5,898,380 | A | * | 4/1999 | Chi | F21V 15/04 340/321 |
| 5,931,571 | A | * | 8/1999 | Chi | F21V 15/04 362/249.01 |
| 7,824,082 | B2 | | 11/2010 | Hanson | |
| 7,849,617 | B2 | | 12/2010 | Intagliata et al. | |
| 2005/0002183 | A1 | | 1/2005 | Wardzala | |

* cited by examiner

SELF-RIGHTENING RISER BASE

BACKGROUND OF THE INVENTION

Field of the Invention

This invention relates to a riser base that self-rightens a riser coupled thereto when forced from a desired orientation by an object.

Background

More and more people are installing security and/or safety lights around their home, such as around entrances or along walkways. These lawn lights are coupled to a base in the ground by a riser. It is desirable that the riser extend vertically up from the ground however the lights and riser are prone to being struck and forced from vertical by lawnmowers, people, balls, pets and the like. It is challenging and time consuming to righten the risers and it can become very frustrating. Some risers and fixtures attached thereto can break when deflected by an object, requiring replacement, which can become costly.

SUMMARY OF THE INVENTION

The invention is directed to a self-rightening riser base system comprising a self-rightening riser base that self-rightens a riser coupled thereto when forced from a desired orientation by an object. An exemplary self-rightening riser base comprises a floating flange coupled to a riser coupler that can deflect and return back to a desired orientation. The floating flange is coupled to a cap by spring bolts, that allow the floating flange and riser coupler to deflect when the riser is forced from a desired orientation. A riser is configured to be coupled to the riser coupler and extends up from the cap of the self-rightening riser base. In addition, the exemplary self-rightening riser base enables a person to set a desired orientation of the riser by adjustment of the riser bolts. For example, the ground may not be flat and the housing in the ground may be offset from vertical. A user may couple the self-rightening riser base to the offset housing and then turn the spring bolts as required to set the riser vertical.

An exemplary self-rightening riser base comprises a cap for coupling with a housing, such as a tube that may be configured in the ground. The cap has a top surface and extension extending down from the top surface to an extended end. The cap may be cylindrical in shape and configured to fit over a cylindrical housing. The fit between the cap and the housing may be small and overtime it may become difficult to remove the cap from the housing. In an exemplary embodiment, a plurality of housing bolts extend through the cap and align with the top of the housing. The housing bolts can be turned to force the cap up and off of the housing as required.

In an exemplary embodiment, a riser is coupled with the self-rightening riser base and extends up from the cap. A riser may extend up to a fixture such as an electrical fixture including, but not limited to a light or audio device, sensor, sign and the like, or a water fixture, such as a sprinkler head, for example. A fixture lead, such as an electric wire may extend through the housing, and then up through the floating flange and finally through the riser to the fixture.

An exemplary self-rightening riser base comprises a floating flange that is coupled to the cap by a plurality of spring-bolts. The springs bolts extend through the cap and are coupled with the floating flange. The spring bolts may have threaded extended ends that screw into threaded apertures in the floating flange. A spring bolt may be affixed to the floating flange and may not have a threaded end however. The spring-bolt apertures in the cap are oversized to allow deflection of the spring bolts when the riser is defected or offset from vertical by an object. A grommet may extend through the spring-bolt apertures in the cap to allow this deflection. The grommets may be an elastic material to allow compression and a return to an original shape after a compressive load is removed. An O-ring may be configured under the bolt heads of the spring bolts to prevent rain from passing through the spring-bolt apertures and into the housing. An exemplary self-rightening riser base may comprise three or more spring bolts to allow orientation of the riser by manipulation of the bolts, such as three or more, about four or more, about five or more, about six or more and any range between and including the number of spring bolts listed. If the housing in not vertical and a vertical riser is desired, the spring bolts can be manipulated to offset the floating flange and riser coupler coupled thereto to produce a vertical riser. The springs between the floating flange and the cap may by helical springs that are configured around the spring bolts, or an elastomeric material, such as a sleeve configured around the spring bolts. The floating flange may be offset from the bottom of the cap an offset distance which may be about 20 mm or more, about 40 mm or more, about 50 mm or more, about 70 mm or more and any range between and including the offset distances provided.

A riser coupler is coupled to the floating flange and is configured to couple the riser thereto. A riser coupler may be a threaded aperture in the floating flange or may have an extension from the floating flange toward the cap to a riser end. The riser end may have a coupling for the riser, such as threads. In an exemplary embodiment, the riser coupler extends up from the floating flange to the riser coupler aperture in the cap. A riser coupler may be detachably attached to the floating flange. In an exemplary embodiment, a riser coupler may be changed to accommodate attachment to a different type of riser, such as a riser having a different attachment end; different threads for example. A riser with a threaded attachment end may be easily coupled to the riser coupler by locating the attachment end of the riser in the riser coupler aperture and rotating to thread the riser to the riser coupler.

The riser coupler aperture in the cap may comprise a grommet made from a compressible and elastomeric material. The riser coupler aperture is oversized to produce a gap between the riser or riser coupler and the cap. This gap enables the riser to deflect. The grommet may seal the riser coupler aperture around the riser or riser coupler to prevent water and debris from passing therethrough. An exemplary grommet is elastic and compressible to allow deflection of the riser an offset angle of about 20 degrees or more, about 30 degrees or more, about 40 degrees or more, about 50 degrees, about 60 degrees and any range between and including the offset angles provided.

In use, the self-rightening riser base provides for a self-rightening riser, whereby the riser will return to a pre-set orientation after being moved an offset distance by an object. The riser may be defected by an object and then when the deflecting force is removed, the springs of the spring bolts will return the floating flange back to an original orientation and thereby righten the riser to an original orientation. In addition, the spring bolts may be used to offset the floating flange where by the offset distance is not uniform around the outside of the flange. This may be done when the ground is not flat and/or when the housing is not vertical in the ground.

This may also be required when the top of the housing is not orthogonal to vertical, or horizontal.

The summary of the invention is provided as a general introduction to some of the embodiments of the invention, and is not intended to be limiting. Additional example embodiments including variations and alternative configurations of the invention are provided herein.

BRIEF DESCRIPTION OF SEVERAL VIEWS OF THE DRAWINGS

The accompanying drawings are included to provide a further understanding of the invention and are incorporated in and constitute a part of this specification, illustrate embodiments of the invention, and together with the description serve to explain the principles of the invention.

Figure 1:
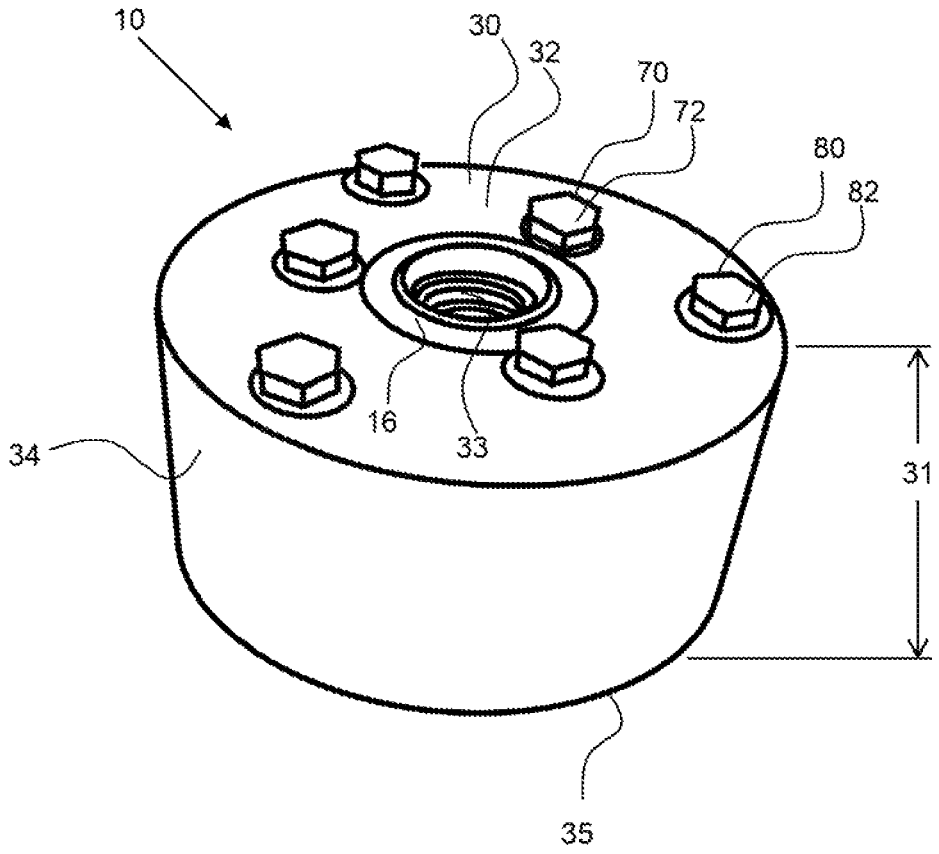
FIG. 1 shows a perspective view of an exemplary self-rightening riser base.

Corresponding reference characters indicate corresponding parts throughout the several views of the figures. The figures represent an illustration of some of the embodiments of the present invention and are not to be construed as limiting the scope of the invention in any manner. Further, the figures are not necessarily to scale, some features may be exaggerated to show details of particular components. The invention is scalable within the structural limits of the housing an dcap used as well as the weight of the riser. Therefore, specific structural and functional details disclosed herein are not to be interpreted as limiting, but merely as a representative basis for teaching one skilled in the art to variously employ the present invention.

DETAILED DESCRIPTION OF THE ILLUSTRATED EMBODIMENTS

As used herein, the terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus. Also, use of "a" or "an" are employed to describe elements and components described herein. This is done merely for convenience and to give a general sense of the scope of the invention. This description should be read to include one or at least one and the singular also includes the plural unless it is obvious that it is meant otherwise.

Certain exemplary embodiments of the present invention are described herein and are illustrated in the accompanying figures. The embodiments described are only for purposes of illustrating the present invention and should not be interpreted as limiting the scope of the invention. Other embodiments of the invention, and certain modifications, combinations and improvements of the described embodiments, will occur to those skilled in the art and all such alternate embodiments, combinations, modifications, improvements are within the scope of the present invention.

Definitions

Elastomeric is a material that can be compressed by a compressive load and then return to an original shape upon removal of the compressive load.

Figure 2:
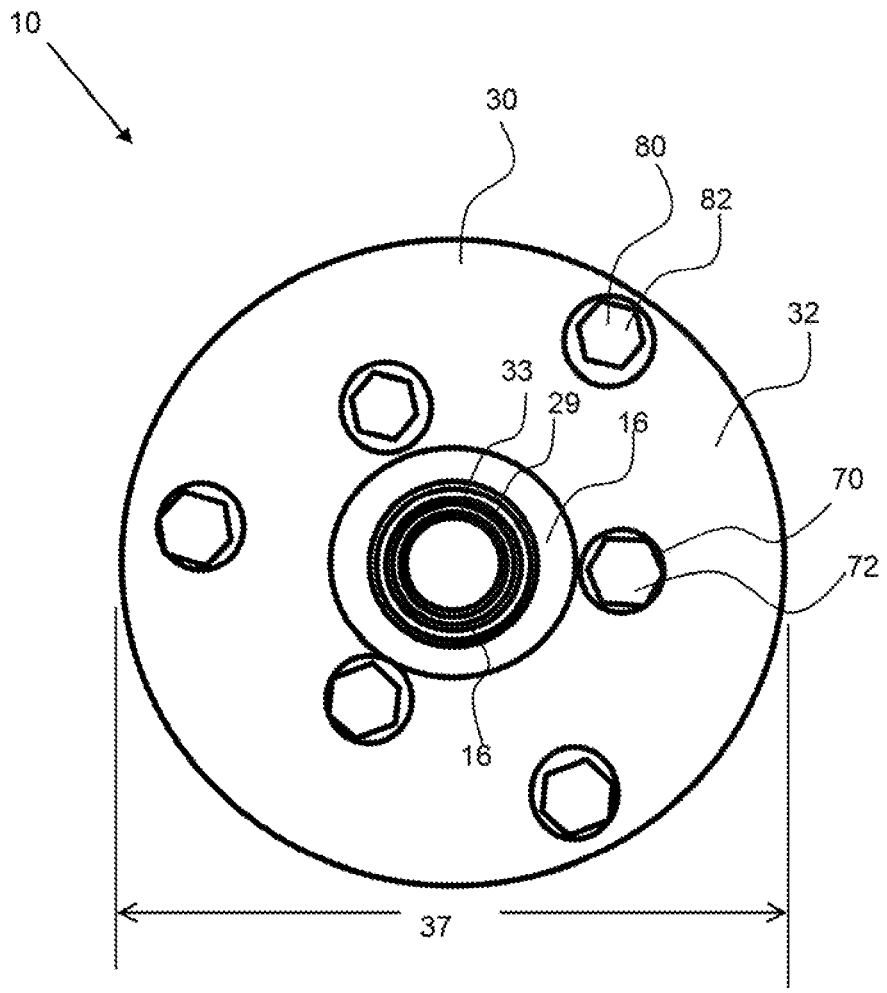
FIG. 2 shows a top view of an exemplary self-rightening riser base having a riser coupler aperture centrally located in the base.

Referring now to FIGS. 1 and 2, an exemplary self-rightening riser base 10 comprises a cap 30 having a riser coupler aperture 33 therethrough. A grommet 16 is configured in the riser coupler aperture and has a flange that extends over the top surface 32 of the cap and over the bottom surface of the cap, to produce a seal around the riser as it moves within the flexible grommet. A riser can be detachable attached to the base by a threaded attachment, for example. The riser may have a threaded end that screws into a riser coupler (not visible in this view). A plurality of spring bolts 70 extend through the cap and couple with a floating flange. The spring bolt heads 72 are shown and the spring bolts are spaced evenly around the riser coupler aperture, or substantially 120 degrees apart, such as within +/10 degrees of 120 degrees. A plurality of housing bolts 80 extend through the cap and provide a means to remove the cap from a housing when required. Again, the housing bolt heads 82 may be spaced evenly around the riser coupler aperture, or about 120 degrees apart. The cap 30 has extensions 34 from the top surface and a height 31 from the top surface 32 to the extended end 35 of the extensions. The cap has an outer diameter 37, as shown in FIG. 2.

Figure 3:
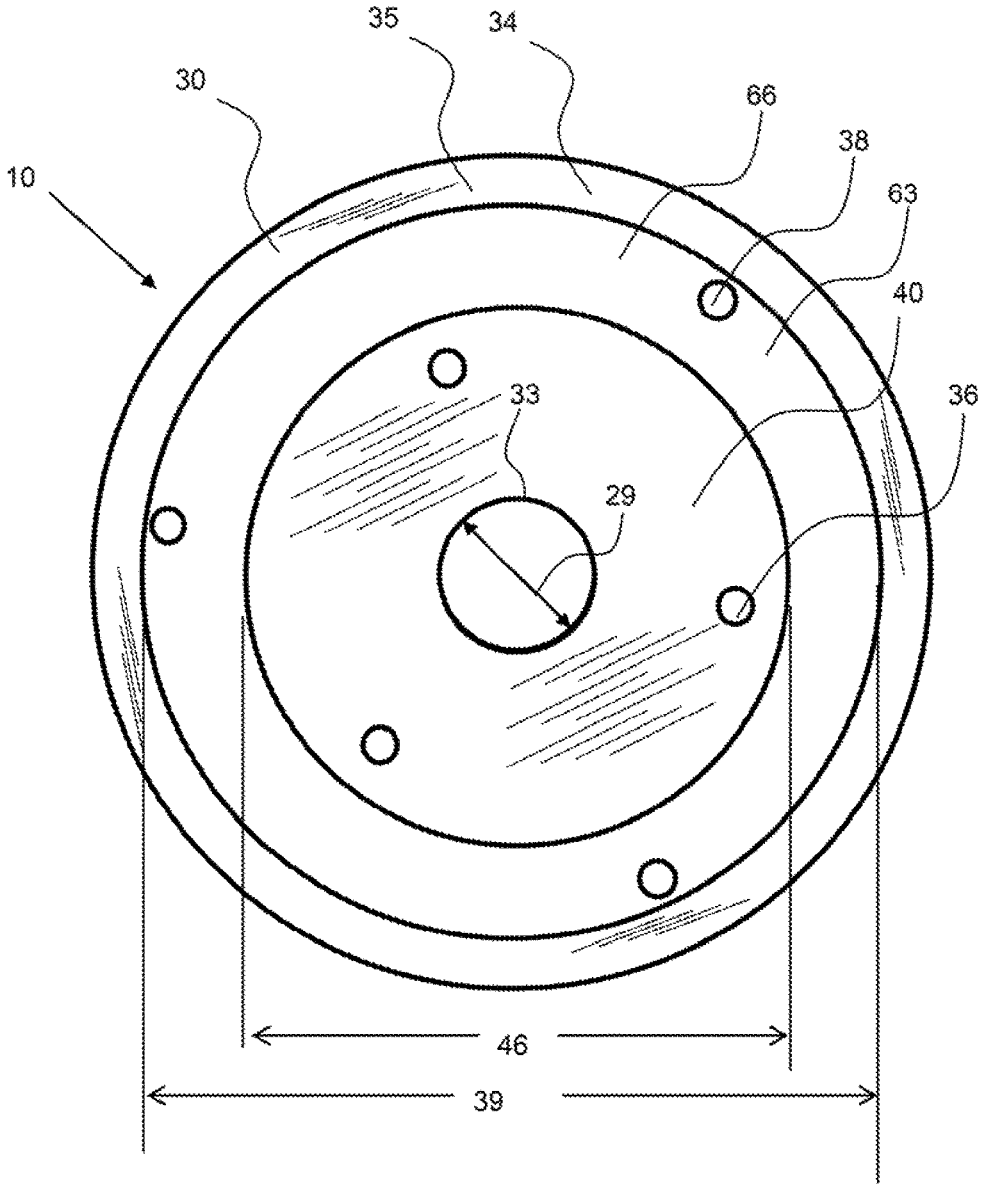
FIG. 3 shows a bottom view of an exemplary self-tightening riser base having a floating flange coupled to the cap.
Figure 4:
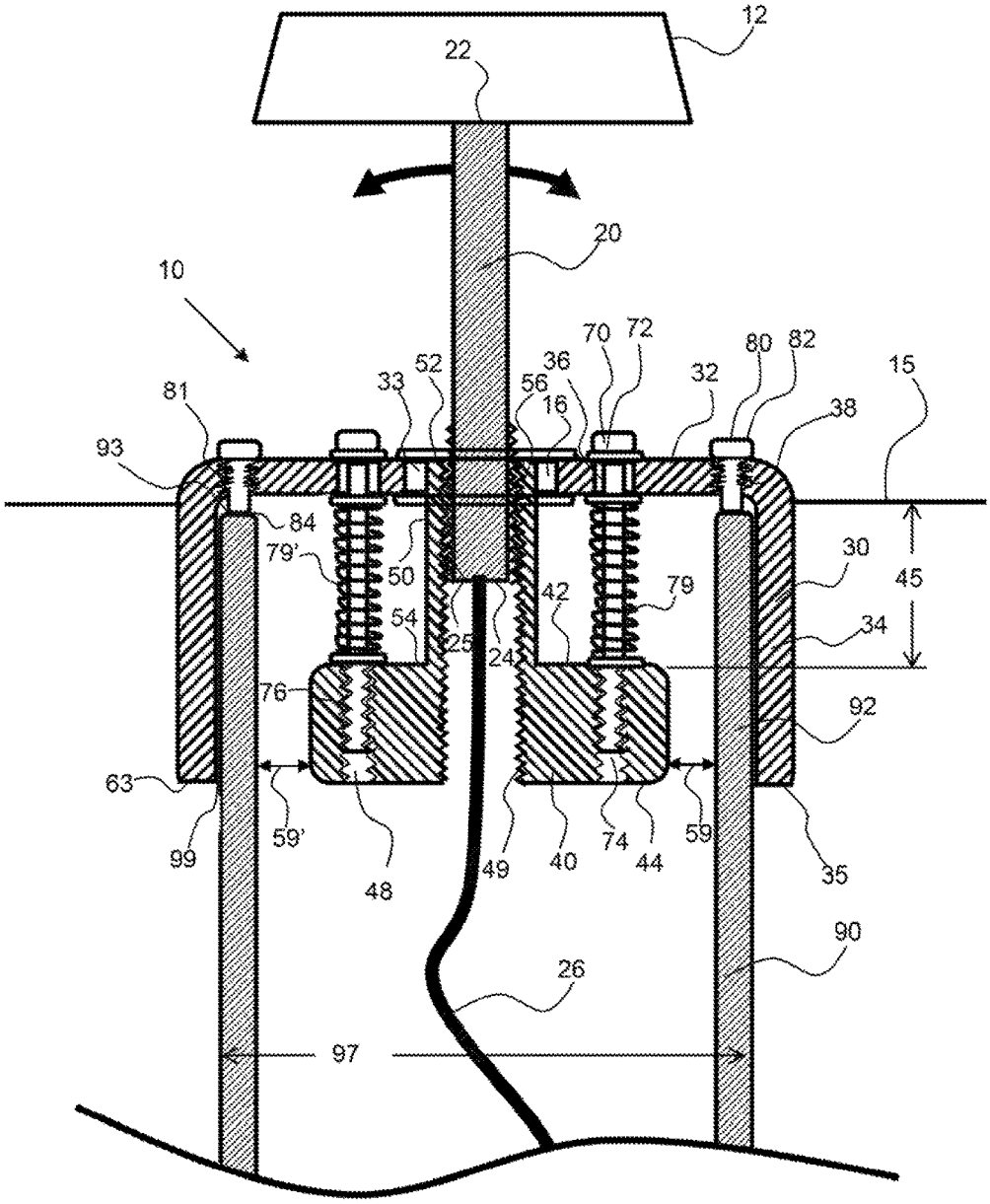
FIG. 4 shows a cross-sectional view of an exemplary self-rightening riser base having a floating flange coupled to the cap by a plurality of spring bolts.

As shown in FIG. 3, an exemplary self-rightening riser base 10 has a floating flange 40 coupled to the cap 30 by spring bolts (not visible in this view). The spring bolts are coupled to the floating flange and may extend into spring bolt apertures 36. The riser coupler aperture 33 may extend through the floating flange and has a riser coupler aperture diameter 29 that is oversized to allow the riser to deflect. Note that the riser coupler aperture may extend partially into the floating flange. A housing channel 66 extends as a ring around the outer diameter 46 of the floating flange 40 and the extension 34, or the inner diameter 39 of the cap; the bottom surface 63 of the cap shown defines this channel in this view. The outer diameter 97 of a housing, shown in FIG. 4, is configured to fit within the inner diameter 39 of the cap. As shown in FIG. 3, the housing bolt aperture 38 are configured through the top surface of the cap to align with this housing channel 66 and when installed over a housing, to align with the top surface of the housing.

Figure 5:
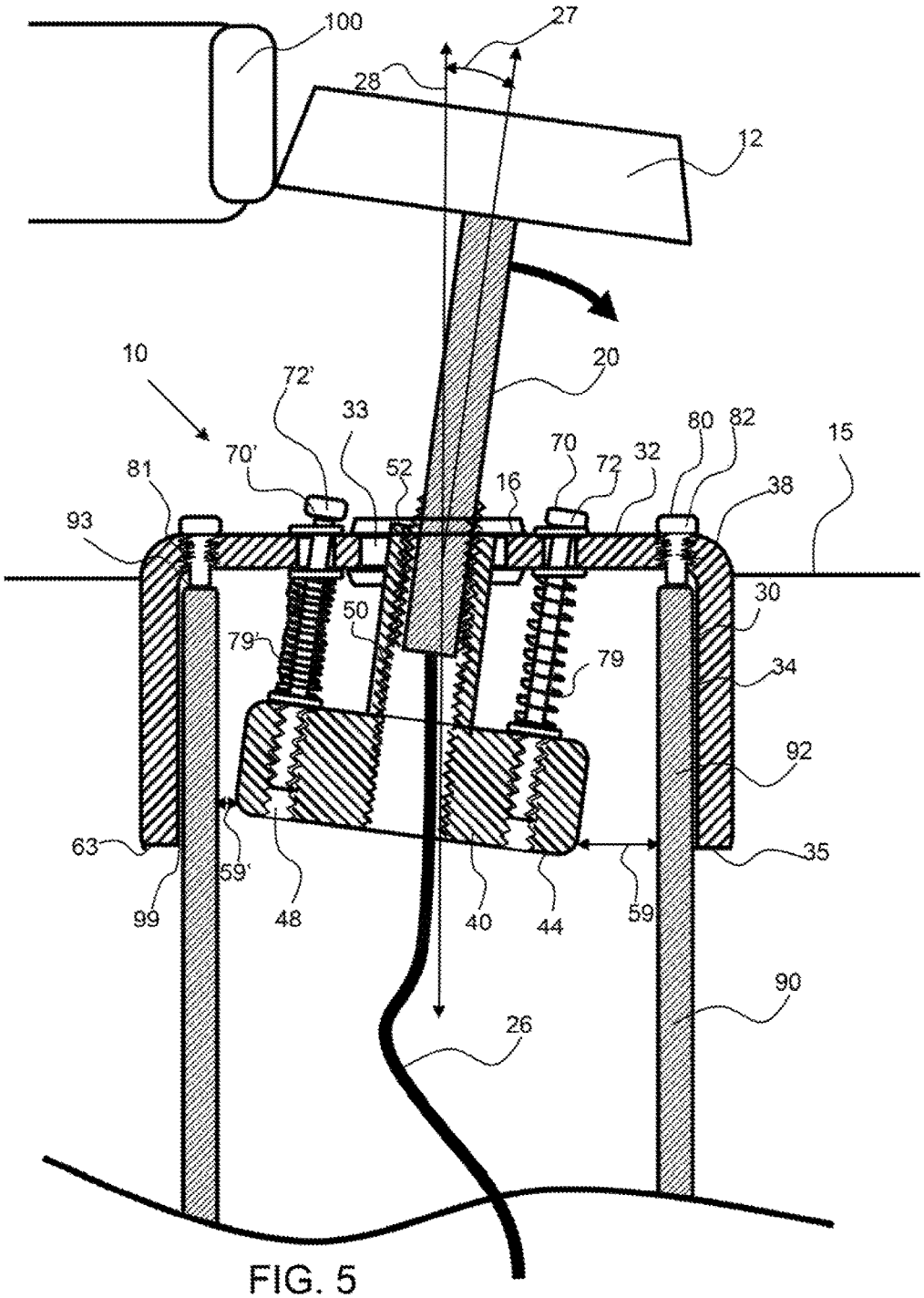
FIG. 5 shows a cross-sectional view of an exemplary self-rightening riser base being deflected by an object.

Referring now to FIGS. 4 and 5, an exemplary self-rightening riser base 10 has a riser 20 coupled thereto and a fixture coupled to the riser, such as a light fixture. The cap 30 of the self-rightening riser base 10 is configured over a housing 90 and the housing is configured at least partially below a ground level 15. The riser extends up from the ground level. The self-rightening riser base 10 has a floating flange 40 coupled to the cap 30 by a plurality of spring bolts 70. The spring bolts extend through the top surface 32 of the cap and are coupled with floating flange, such as by being threaded into spring bolt apertures 48 in the floating flange. The spring bolt aperture in the floating flange may comprise female threads for engagement with male threads 76 on the spring bolts, and may extend all the way through the floating flange from the top surface 42 to the bottom surface 44, or only a portion of the way through the floating flange. The spring bolts may comprise threads on the extended ends 74. Springs 79, 79' are configured around the spring bolts and produce a force between the bottom surface of the cap and the floating flange to self-righten the riser in the event of a deflection. The floating flange is offset an offset distance 45 from the bottom surface 63 of the cap 30, which allows the floating flange to move when the riser is deflected. The offset distance is from the top of the floating flange 42 to the bottom of the cap. Note that a third spring-bolt is configured behind the riser coupler and is not visible in FIGS. 4 and 5.

The riser 20 is coupled with a riser coupler 50 of the self-rightening riser base 10 which allows the riser to deflect, as shown in FIG. 5. The riser coupler is coupled to the floating flange 40 and may be an extension from the floating flange as shown. The riser coupler may extend up from the floating flange as shown, or may be an aperture within the floating flange. The riser has a length from a fixture end 22 to and attachment end 24 and the attachment end may comprise threads 25, such a male threads configured to screw into female threads 49 in the riser coupler. The exemplary riser coupled has a length from the riser end 52 to the flange end 54. The riser coupler or the riser end of the riser coupler may comprise a threaded riser aperture 56 to allow the riser to thread therein. As shown in FIG. 4, the housing 90 is vertical and therefore the cap sits over the housing to support a riser that extends vertically up therefrom. The housing wall 92 extends up between the floating flange and the extension 34 of the cap 30 and a gap 59 is produced between the housing and the floating flange to allow the floating flange to move, as shown in FIG. 5. In FIG. 5, an object 100, such as a lawn mower, has hit the fixture 12 and has deflected the riser an offset angle 27 from vertical, or from the vertical axis 28. The spring 79 around spring bolt 70 is elongated and the spring 79' around spring bolt 70' is compressed to produce a force to realign or self-righten the riser to vertical when the deflecting force is removed. Note that the gap 59 is enlarged and the gap 59' is reduced in FIG. 5 from that shown in FIG. 4. Again, a third spring-bolt is configured behind the riser coupler and is not visible in FIGS. 4 and 5.

A grommet 16 extends through the riser coupler aperture 33 in the cap and in an exemplary embodiment is a compressible and resilient elastomeric material, to enable the riser to deflect within the grommet. As shown, the grommet has a flange along the top surface of the cap and along the bottom surface of the cap to produce a seal. The riser coupler aperture 33 is oversized and larger in dimension, such as diameter, than the riser coupler or riser that extends therethrough. The riser coupler aperture may be at least 20% larger or more, 30% larger or more, 40% larger or more than the diameter of the riser or riser coupler.

The cap 30 extends over the housing wall 92 and may sit on the top of the housing wall 93. The cap may fit snuggly over the housing 90 and have a very small gap 99 therebetween. In an exemplary embodiment, the cap extension is a cylinder and the housing is also a cylinder to allow a fixture lead 26 to extend therethrough to the riser 20 and through the riser to the fixture. A fixture lead may be an electrical lead and the fixture may be a light or the fixture lead may be a conduit for water and the fixture may be sprinkler head, for example. Overtime, the cap may become difficult to remove from the housing. The housing bolts 80 comprise threads 81 that are threaded through the threaded housing bolt apertures 38 in the cap to align with the top of the housing 93. The housing bolts can be turned to force extended ends 84 downward to press the cap up and off of the housing in this case.

Figure 6:
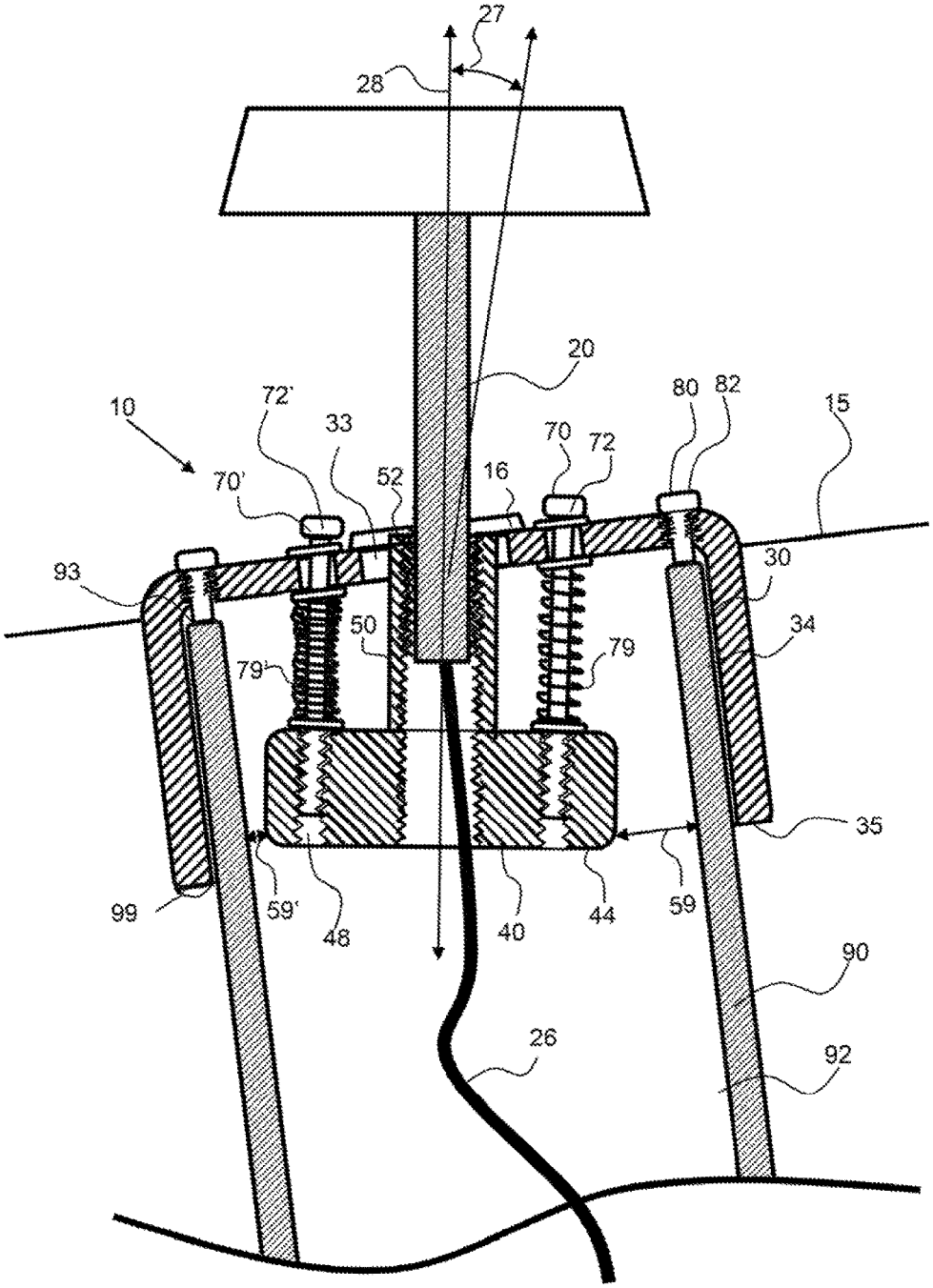
FIG. 6 shows a cross-sectional view of an exemplary self-rightening riser base that has been adjusted by the spring bolts to produce a vertical riser when the base housing is not oriented in the ground vertically.

As shown in FIG. 6, an exemplary self-rightening riser base 10 is configured over a housing that is not vertical. The spring bolts have been turned to deflect the floating flange 40 to produce a vertical riser 20. As shown, spring bolt 70 has been turned to extend the floating flange away from the top surface cap and spring bolt 70' has been turned to bring the floating flange toward the top surface of the cap. Spring 79 is elongated and spring 79' is compresses as a result of manipulating the spring bolts.

It will be apparent to those skilled in the art that various modifications, combinations and variations can be made in the present invention without departing from the scope of the invention. Specific embodiments, features and elements described herein may be modified, and/or combined in any suitable manner. Thus, it is intended that the present invention cover the modifications, combinations and variations of this invention provided they come within the scope of the appended claims and their equivalents.

What is claimed is:

1. A self-rightening riser base system comprising:

a) a cap comprising:
  i) a top surface;
  ii) a lower surface;
  iii) extensions extending down from the top surface;
  iv) three or more spring bolt apertures configured through the top surface;
  v) a riser coupler aperture;

b) a spring bolt that extends through each of the spring bolt apertures;

c) a floating flange;
  wherein each of the spring bolts are secured to the floating flange and
  wherein the floating flange is offset an offset distance from the lower surface of cap;

d) a spring configured around each of the spring bolts between the cap and the floating flange;

e) a riser coupler having an attachment feature for coupling with a riser;

f) said riser having an attachment end that is coupled with the riser coupler and wherein the riser extends up from the cap;
  wherein the riser coupler aperture is oversized to allow the riser to deflect an offset angle of at least 20 degrees; and
  wherein the springs configured around the spring-bolts return the riser to an original orientation after the riser is deflected said offset angle by a deflection force.

2. The self-rightening riser bracket base of claim 1, further comprising an electrical fixture coupled to a fixture end of the riser; and wherein the riser has a conduit from said fixture end to the attachment end, and
  wherein an electrical lead extends through the cap, through the riser coupler, through the conduit in the riser to the fixture.

3. The self-rightening riser bracket base of claim 1, wherein the attachment end of the riser comprises threads and wherein the riser coupler comprises threads configured to couple with said threads of the riser to attach the riser to the riser coupler.

4. The self-rightening riser bracket base of claim 3, wherein the attachment end of the riser has male threads configured to thread into female threads of the riser coupler.

5. The self-rightening riser bracket base of claim 1, further comprising a grommet configured in the riser coupler aperture.

6. The self-rightening riser bracket base of claim 5, wherein the grommet comprises an elastomeric material.

7. The self-rightening riser bracket base of claim 1, wherein the riser coupler extends up from the floating flange toward the riser coupler aperture in the cap.

8. The self-rightening riser bracket base of claim 7, wherein the riser coupler extends into the riser coupler aperture.

9. The self-rightening riser bracket base of claim 7, wherein the riser coupler is detachably attachable to the floating flange.

10. The self-rightening riser bracket base of claim 1, wherein the riser coupler aperture is oversized to allow the riser to deflect an offset angle of at least 30 degrees.

11. The self-rightening riser bracket base of claim 1, wherein the riser coupler aperture is oversized to allow the riser to deflect an offset angle of at least 40 degrees.

12. The self-rightening riser bracket base of claim 1, wherein the spring bolt apertures in the cap are oversized to allow the spring bolts to move within the spring bolt aperture.

13. The self-rightening riser bracket base of claim 1, comprising three spring bolts and wherein they are configured substantially 120 degrees apart about the riser coupler aperture.

14. The self-rightening riser bracket base of claim 1, further comprising a housing that is configured inside of the cap, below the top surface of the cap and inside of the extensions of the cap, between the extensions and the floating flange.

15. The self-rightening riser bracket base of claim 14, further comprising a housing bolt that extends through the cap and is aligned with a top of the housing.

16. The self-rightening riser bracket base of claim 15, comprising a plurality of housing bolts.

17. The self-rightening riser bracket base of claim 15, wherein the housing is a cylinder.

18. The self-rightening riser bracket base of claim 15, wherein the riser has a conduit from a fixture end to an attachment end, and further comprising an electrical fixture coupled to the riser; and wherein an electrical lead extends through the cap, through the riser coupler, through the conduit in floating flange.

19. The self-tightening riser bracket base of claim 1, wherein the springs are coiled springs that are coiled about the spring bolt.

20. A self-rightening riser base system comprising:

a) a cap comprising:
   i) a top surface;
   ii) a lower surface;
   iii) extensions extending down from the top surface;
   iv) three or more spring bolt apertures configured through the top surface;
   v) a riser coupler aperture;

b) a spring bolt that extends through each of the spring bolt apertures;

c) a floating flange;
   wherein each of the spring bolts are secured to the floating flange and
   wherein the floating flange is offset an offset distance from the lower surface of cap;

d) a spring configured around each of the spring bolts between the cap and the floating flange;

e) a riser coupler having an attachment feature for coupling with a riser;

f) a grommet configured in the riser coupler aperture and wherein the grommet is made of an elastic material;

g) said riser having a length from an attachment end, attached to the riser coupler, to a fixture end, and wherein the riser extends up from the cap and has a conduit from said fixture end to the attachment end;
   wherein the attachment end of the riser comprises threads and wherein the riser coupler comprises threads configured to couple with said threads of the riser to attach the riser to the riser coupler;
   wherein the riser coupler aperture is oversized to allow the riser to deflect an offset angle of at least 20 degrees; and
   wherein the springs configured around the spring-bolts return the riser to an original orientation after the riser is deflected said offset angle by a deflection force.

* * * * *